US008100291B2

(12) United States Patent
Dikken

(10) Patent No.: US 8,100,291 B2
(45) Date of Patent: Jan. 24, 2012

(54) UPRIGHT ROTATABLE PRODUCT CARROUSEL DISPENSING DEVICE

(76) Inventor: Mark P. Dikken, Caledon (CA)

( * ) Notice: Subject to any disclaimer, the term of this patent is extended or adjusted under 35 U.S.C. 154(b) by 503 days.

(21) Appl. No.: 12/342,890

(22) Filed: Dec. 23, 2008

(65) Prior Publication Data

US 2009/0166371 A1 Jul. 2, 2009

Related U.S. Application Data

(60) Provisional application No. 61/016,835, filed on Dec. 27, 2007.

(51) Int. Cl.
*G07F 11/00* (2006.01)

(52) U.S. Cl. ..... 221/120; 221/119; 221/113

(58) Field of Classification Search ..... 221/92, 221/112, 113, 119, 120
See application file for complete search history.

(56) References Cited

U.S. PATENT DOCUMENTS

| | | | | |
|---|---|---|---|---|
| 1,397,615 | A * | 11/1921 | Bassett | 221/83 |
| 1,715,726 | A * | 6/1929 | Tomoda | 221/83 |
| 1,754,487 | A * | 4/1930 | Schweitzer | 312/36 |
| 1,913,917 | A * | 6/1933 | Crowe | 221/82 |
| 2,766,905 | A * | 10/1956 | Heinig | 221/83 |
| 4,192,436 | A | 3/1980 | Schuller et al. | |
| 4,842,161 | A * | 6/1989 | Krakauer | 221/76 |
| 5,176,285 | A * | 1/1993 | Shaw | 221/3 |
| 5,219,094 | A * | 6/1993 | Labriola | 221/76 |
| 5,553,736 | A | 9/1996 | Healis | |
| 5,755,357 | A * | 5/1998 | Orkin et al. | 221/82 |
| 5,996,838 | A | 12/1999 | Bayer et al. | |
| 6,230,930 | B1 | 5/2001 | Sorensen et al. | |
| 6,330,957 | B1 * | 12/2001 | Bell-Greenstreet | 221/3 |
| 6,474,501 | B1 | 11/2002 | Volpatti | |
| 6,830,160 | B2 | 12/2004 | Risolia | |
| 7,066,348 | B2 | 6/2006 | Skavnak | |
| 7,137,529 | B2 | 11/2006 | Martinelli et al. | |
| 7,303,093 | B2 | 12/2007 | Ward | |

FOREIGN PATENT DOCUMENTS

JP 2001266238 A * 9/2001

* cited by examiner

*Primary Examiner* — Patrick Mackey
(74) *Attorney, Agent, or Firm* — Samuel M. Freund; Cochran Freund & Young LLC

(57) ABSTRACT

A dispensing device comprising an upright rotatable product carrousel comprising a plurality of dispensing chutes for retaining a product. The dispensing chutes are radially located about a central pivot, with a dispensing point located at a lowest point of rotation of the product carrousel. During use, removal of product from a dispensing chute located at the dispensing point results in rotation of the product carrousel to position an adjacent dispensing chute at the dispensing point, allowing for sequential removal of product from the product carrousel.

21 Claims, 12 Drawing Sheets

UPRIGHT ROTATABLE PRODUCT CARROUSEL DISPENSING DEVICE

RELATED CASES

The present patent application claims the benefit of Provisional Patent Application Ser. No. 61/016,835 filed on Dec. 27, 2007 which application is hereby incorporated by reference herein for all that it discloses and teaches.

FIELD

The present specification relates to a dispensing device, and in particular to a gravity-fed dispensing device suitable for use with products distributed in small and large container formats.

BACKGROUND

Dispensing machines, in particular vending machines have become a popular and convenient method to sell a range of commercial products. For example, vending machines are commonly used to dispense items such as snack foods (e.g. U.S. Pat. No. 7,066,348, U.S. Pat. No. 5,553,736), drink products (e.g. U.S. Pat. No. 5,996,838, U.S. Pat. No. 6,230,930), perishable food items such as sandwiches (e.g. U.S. Pat. No. 4,192,436), hot meals (e.g. U.S. Pat. No. 7,303,093, U.S. Pat. No. 7,137,529), flowers (e.g. U.S. Pat. No. 6,474,501) and multi-media based products (e.g. U.S. Pat. No. 6,830,160).

Dispensing machines are generally located in areas of high pedestrian or vehicular traffic such as schools, shopping centers, commuter terminals and gas stations. In providing convenient access to a product, the dispensing device must be both robust, and dependable.

Many of the vending machines currently in use comprise an array of helical feeder coils arranged with axes perpendicular to the front display area of the vending machine. The helical coil is configured to rotate upon selection of an item, thereby urging the item forward, generally towards a dispensing chute. Once pushed into the dispensing chute, the item generally slides or falls into a dispensing bin at the front of the machine, allowing the consumer access to the item.

Other vending machines, particularly machines designed to dispense carbonated beverage and glass containers rely on ramps and the ability of the item to roll or slide, in order to dispense the product. In general, ramp-based machines retain the product in a storage configuration until a consumer selects the item. Upon selection, the machine releases the product, directing it to a dispensing bin using a series of ramps, thereby preventing excessive agitation of the product, as well as product damage.

While well suited for smaller dimensioned products, the helical feeder and ramp configurations of vending machine are not well suited for larger container formats. Helical feeder vending machines require motors to rotate the coils, while ramp-based configurations require a considerable amount of extra space for the ramp assembly. The overall complexity of vending machines currently being used leads to frequent breakdowns, resulting in an inconvenience to the consumer. In addition, given the larger weight associated with larger container formats, they should not be dispensed in any manner that would allow the container to fall an appreciable distance. Using conventional vending machine technology to dispense, for example, 4 L water containers would likely result in damage to both the product, as well as the vending machine.

With an increasing shift towards automated transactions, dispensing machines will continue to increase in popularity. Products packaged in larger format containers, such as motor oil, water and windshield washer fluid are currently not compatible with traditional dispensing machine technology.

SUMMARY

According to an aspect of an embodiment, provided is a dispensing device comprising:

an upright rotatable product carrousel comprising a plurality of dispensing chutes for retaining a product, said dispensing chutes being radially located about a central pivot;

a dispensing point located at a lowest point of rotation of said product carrousel;

wherein removal of product from a dispensing chute located at said dispensing point results in rotation of the product carrousel to position an adjacent dispensing chute at said dispensing point, allowing for sequential removal of product from the product carrousel.

In some embodiments, the plurality of dispensing chutes of said product carrousel is provided on a rotatable base plate, rotatable about said central pivot.

In some embodiments, each of said plurality of dispensing chutes is further comprised of a outside end plate, an inside endplate, and first and second side walls.

In some embodiments, the dispensing device further comprises a frame for rotatably mounting said upright rotatable product carrousel, said frame providing a shaft for mounting said upright rotatable product carrousel.

In some embodiments, said dispensing device further comprises a housing having an access port or door located at said dispensing point, said access port or door being lockable upon rotation of said upright rotatable product carrousel.

In some embodiments, said dispensing device further comprises a housing having at least one lockable door dimensioned to expose substantially the entire product carrousel upon opening.

In some embodiments, said upright rotatable product carrousel further comprises at least one ballasting weight to facilitate rotation of the product carrousel in instances where the raised center of gravity is insufficient too induce rotation of said upright rotatable product carrousel.

In some embodiments, the dispensing device further comprises two ballasting weights, a first ballasting weight being located at the 2 o'clock position on the upright rotatable product carrousel, and the second ballasting weight being located at the 4 o'clock position on the upright rotatable product carrousel, the second ballasting weight being generally twice the weight of the first ballasting weight.

In some embodiments, the dispensing device further comprises a user interface having at least one of a magnetic card reader, a proximity card reader, a display, a keypad, and a receipt printer.

In some embodiments, said user interface is a payment interface configured to enable payment using at least one of CARDLOCK™, credit card, and debit card.

In some embodiments, said user interface provides indicators to inform a customer of one or more of a ready state, a start state, a dispensing state, a complete state and an out-of-product state.

In some embodiments, the dispensing device further comprises a processing unit for receiving operational information from the upright rotatable product carrousel and controlling operations of the dispensing device.

In some embodiments, said operational information is provided through the use of story plates provided on each of the dispensing chutes, each story plate encoding information about a corresponding dispensing chute, the story plates being read by a logic reader provided in the dispensing device.

In some embodiments, the dispensing device further comprises one or more sensors to detect operational conditions of the dispensing device.

In some embodiments, at least one sensor is provided to detect an out-of-product condition.

In some embodiments, said processing unit is configured to communicate with a remote location through at least one of wired communication and wireless communication.

In some embodiments, a plurality of dispensing devices are provided in a single housing having a common frame structure.

In some embodiments, two dispensing devices are located back-to-back.

In some embodiments, the dispensing device further comprises a brake mechanism to control the rotation of the upright rotatable product carrousel, said brake mechanism being at least one of a mechanical braking system and an energy regenerative braking system.

In some embodiments, the dispensing device operates on DC power.

In some embodiments, said DC power is provided through the use of solar panels provided on at least one surface of the dispensing device.

According to a further aspect of an embodiment, provided is a dispensing device comprising:

a frame presenting a shaft;

an upright product carrousel comprising a central pivot mounted on said shaft, said product carrousel being configured to rotate about said shaft, said product carrousel having a plurality of dispensing chutes for retaining a product, said dispensing chutes being radially located about said central pivot;

a housing for encasing at least said upright product carrousel, said housing providing a dispensing point at a lowest point of rotation of said product carrousel;

a stop mechanism configured to align each of said dispensing chutes at the dispensing point;

wherein removal of product from said dispensing chute located at said dispensing point, and disengagement of said stop mechanism results in rotation of the product carrousel to position an adjacent dispensing chute at said dispensing point, allowing for sequential removal of product from the product carrousel.

FIGURES

Embodiments of the present application will now be described, by way of example only, with reference to the attached Figures, wherein FIG. 1 is a perspective view of an embodiment showing the product carrousel (without the housing);

FIG. 2 is a schematic representation of the product carrousel showing an example numbering convention;

FIGS. 3*a* and 3*b* are perspective views, showing the placement of a divider into a dispensing chute;

FIG. 4*a* is a perspective view of the embodiment of FIG. 1, showing the frame;

FIG. 4*b* is a side sectional view of the embodiment of FIG. 1, showing the central structural support.

Figure 8A:
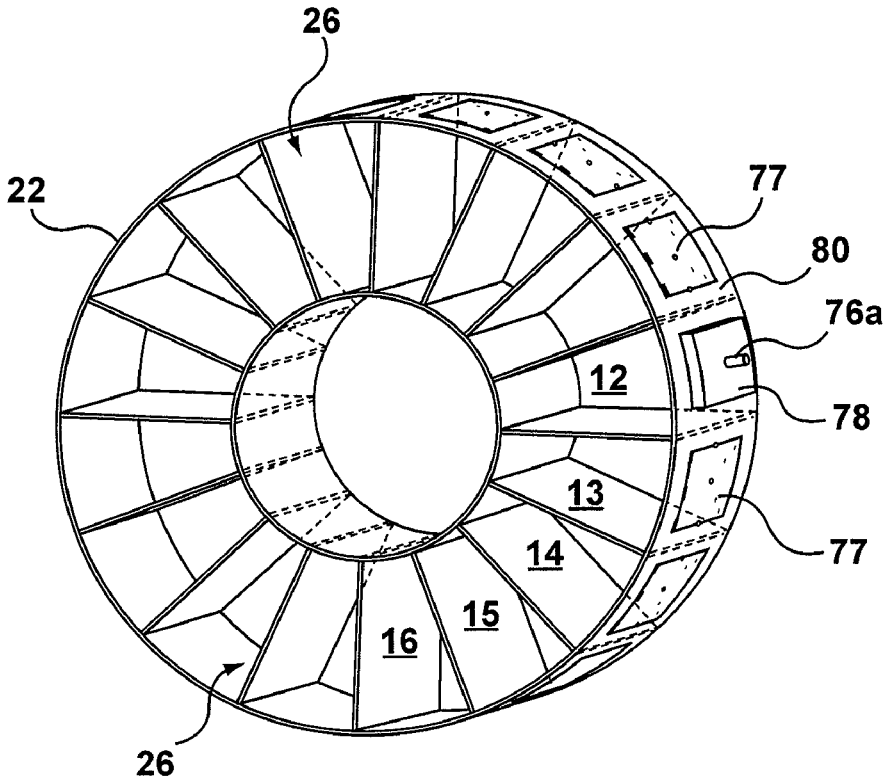
Figure 8B:
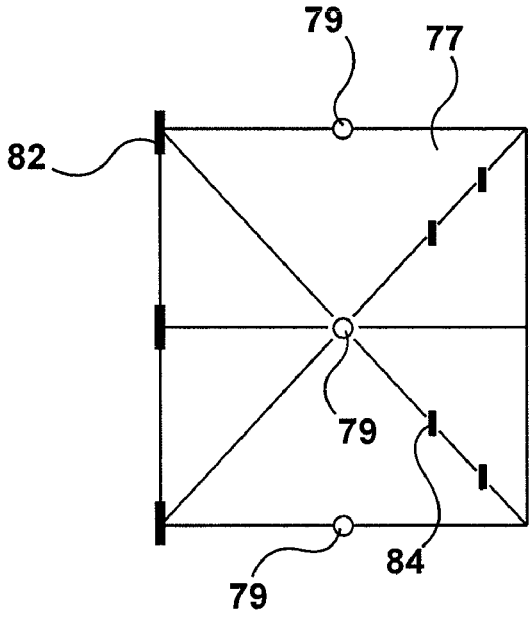
Figure 8C:
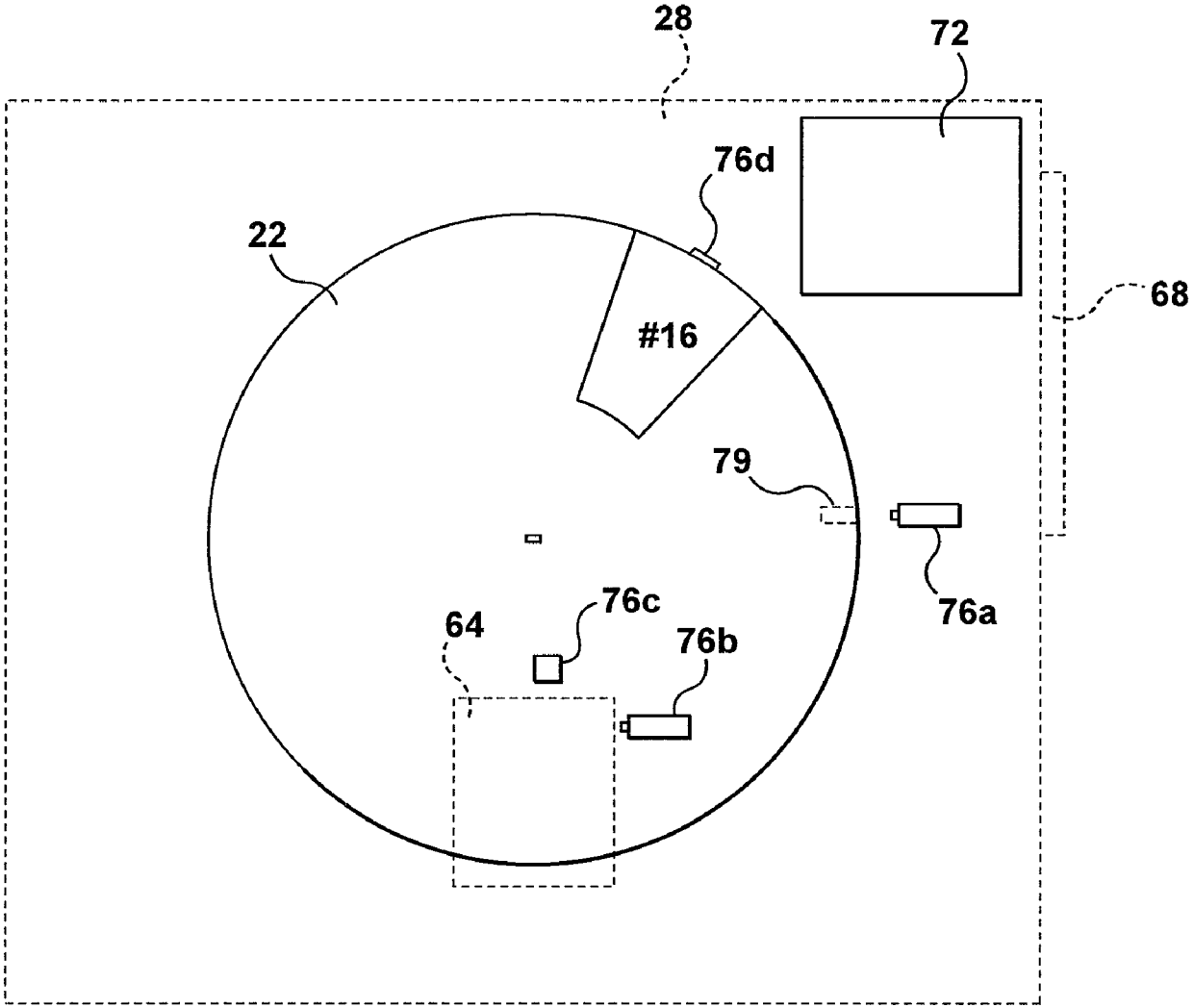

FIG. 8*a* is a perspective view showing the placement of the story plates and logic reader;

FIG. 8*b* is a schematic representation of a story plate;

FIG. 8*c* is a schematic representation of a dispensing device showing exemplary placement of the various controllers used to control the device during operation.

Figure 9:
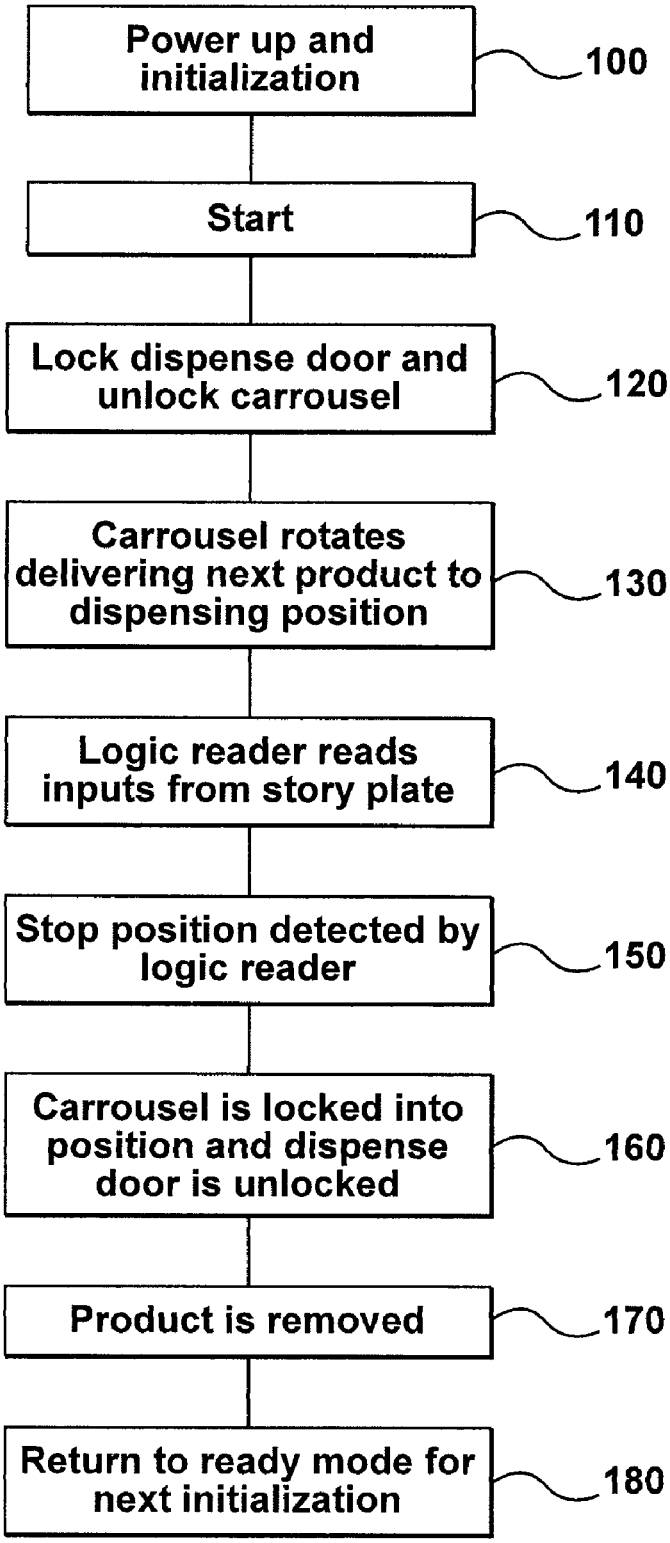

FIG. 9 is a process diagram detailing the general steps associated with dispensing a product.

Figure 10A:
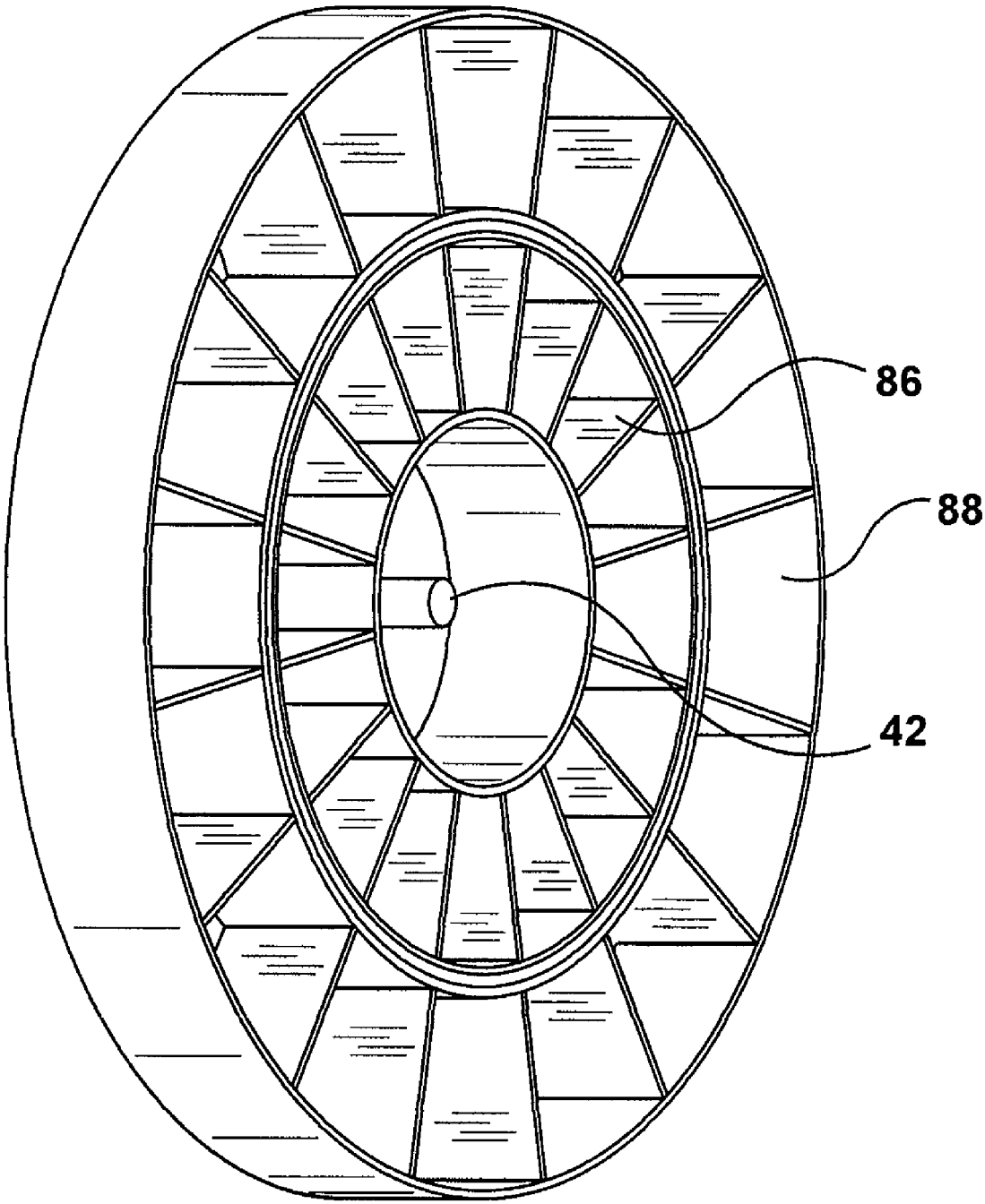
Figure 10B:
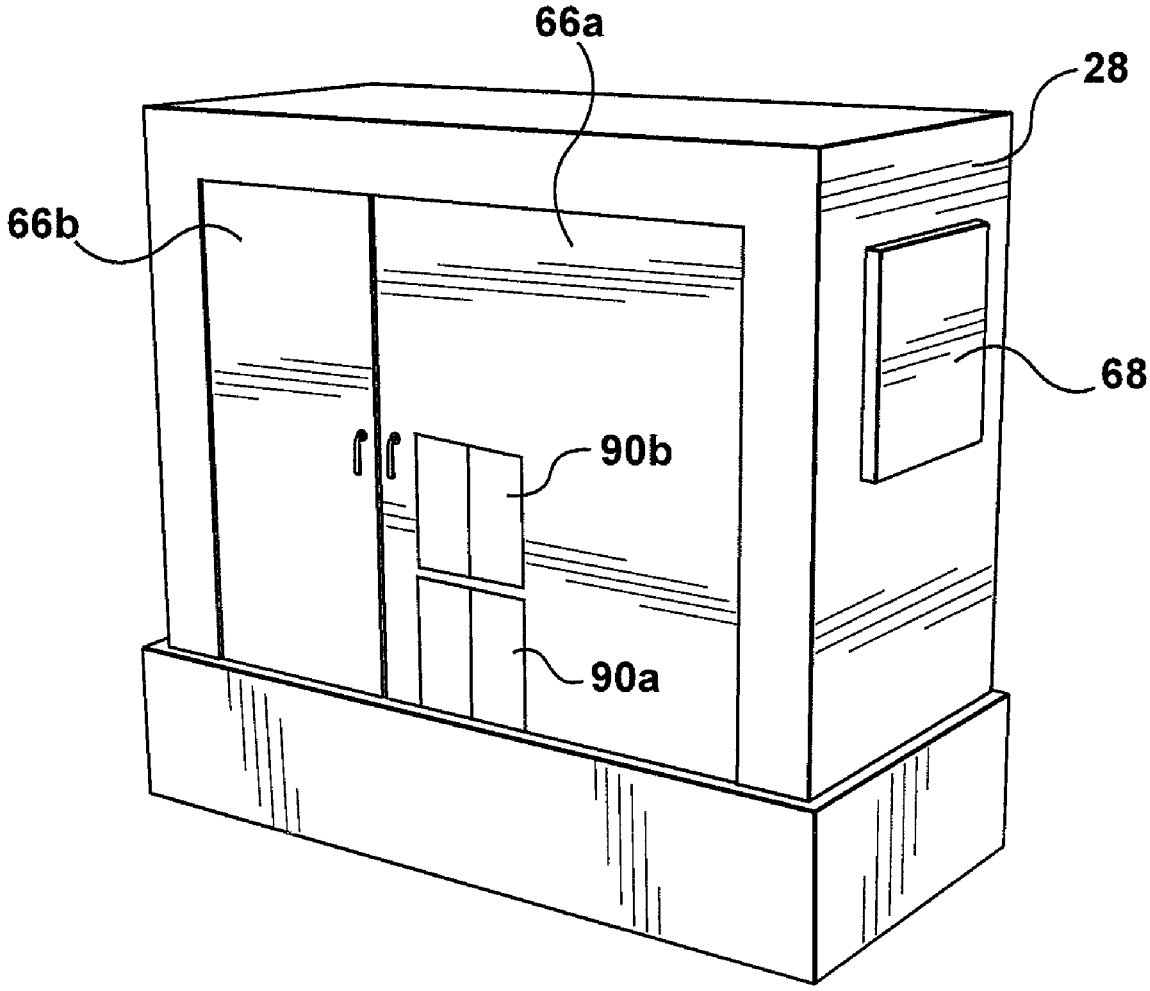

FIG. 10*a* is a perspective view of an alternate embodiment, showing two nested product carrousels for dispensing a product; and FIG. 10*b* is a perspective view of the embodiment of FIG. 10*a*, wherein the nested product carrousels are positioned within a suitable housing.

DETAILED DESCRIPTION OF THE EMBODIMENTS

The following discussion relates to a dispensing device suitable for use in dispensing or vending a packaged product. The dispensing device is suitable for use with products sold in container-format, such as water containers, oil containers, windshield washer fluid, anti-freeze, etc. The dispensing device comprises an upright rotatable product carrousel, configured similar to a Ferris wheel, and generally relies upon gravity to move the product in a sequential manner to a dispensing position. With the removal of product from the lowest compartment of the carrousel (the dispensing position), the product carrousel is capable of freely rotating, without the use of motors or drives, so as to locate in the dispensing position the next product in the carrousel. The operation of the dispensing device can be fully manual, but can also be controlled using a processing unit and a suitable user interface.

Figure 1:
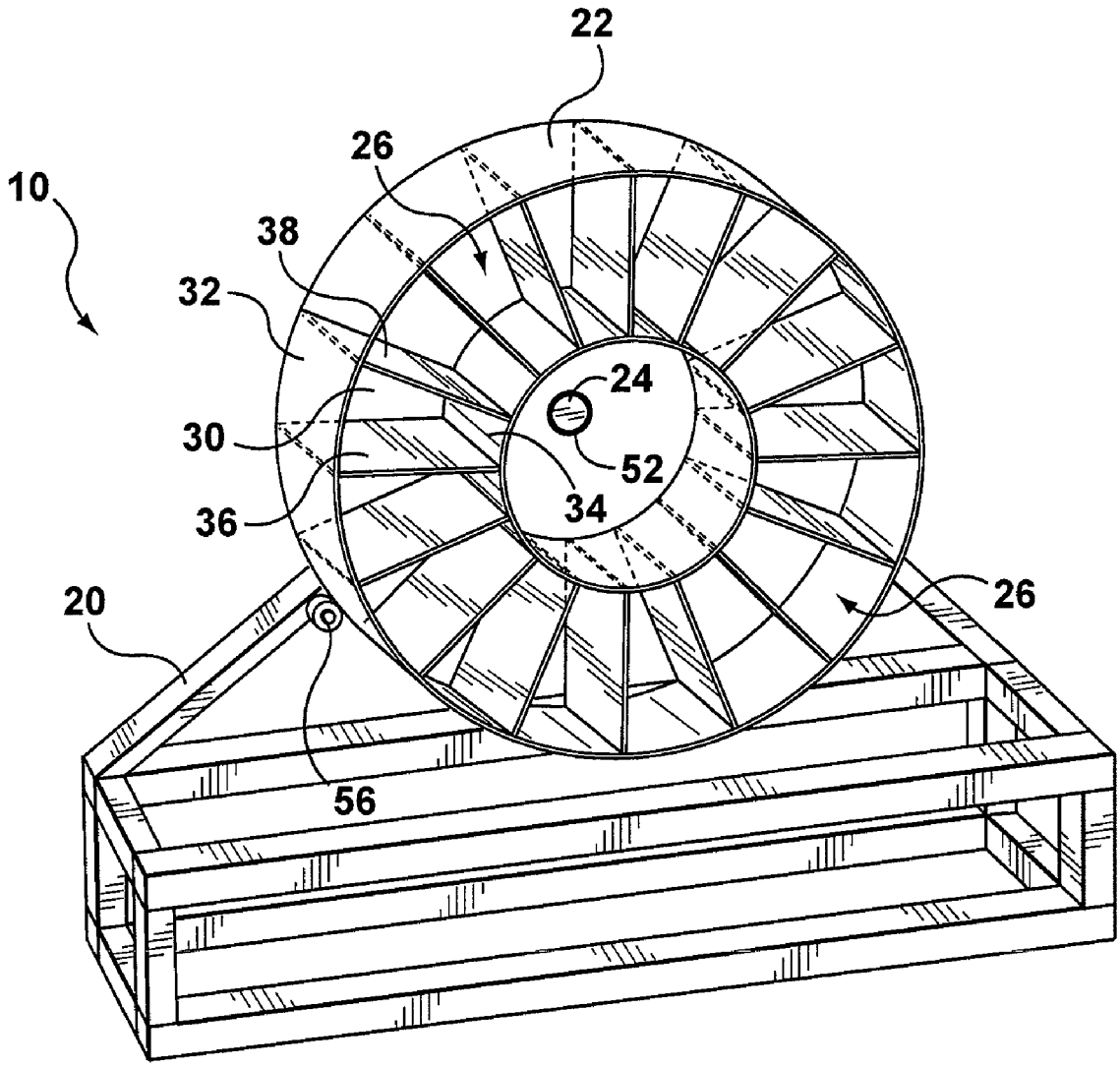

Referring now to FIG. 1, shown is a dispensing device indicated generally by reference numeral 10. The device comprises a frame 20, at least one upright rotatable product carrousel 22, and a center pivot 24 about which the product carrousel 22 is able to rotate. The product carrousel 22 is comprised of a plurality of dispensing chutes 26 for holding product to be dispensed. The product carrousel 22 and frame 20 are contained in a suitable housing 28 (housing not shown in FIG. 1; see FIGS. 5 and 10*b*).

Figure 2:
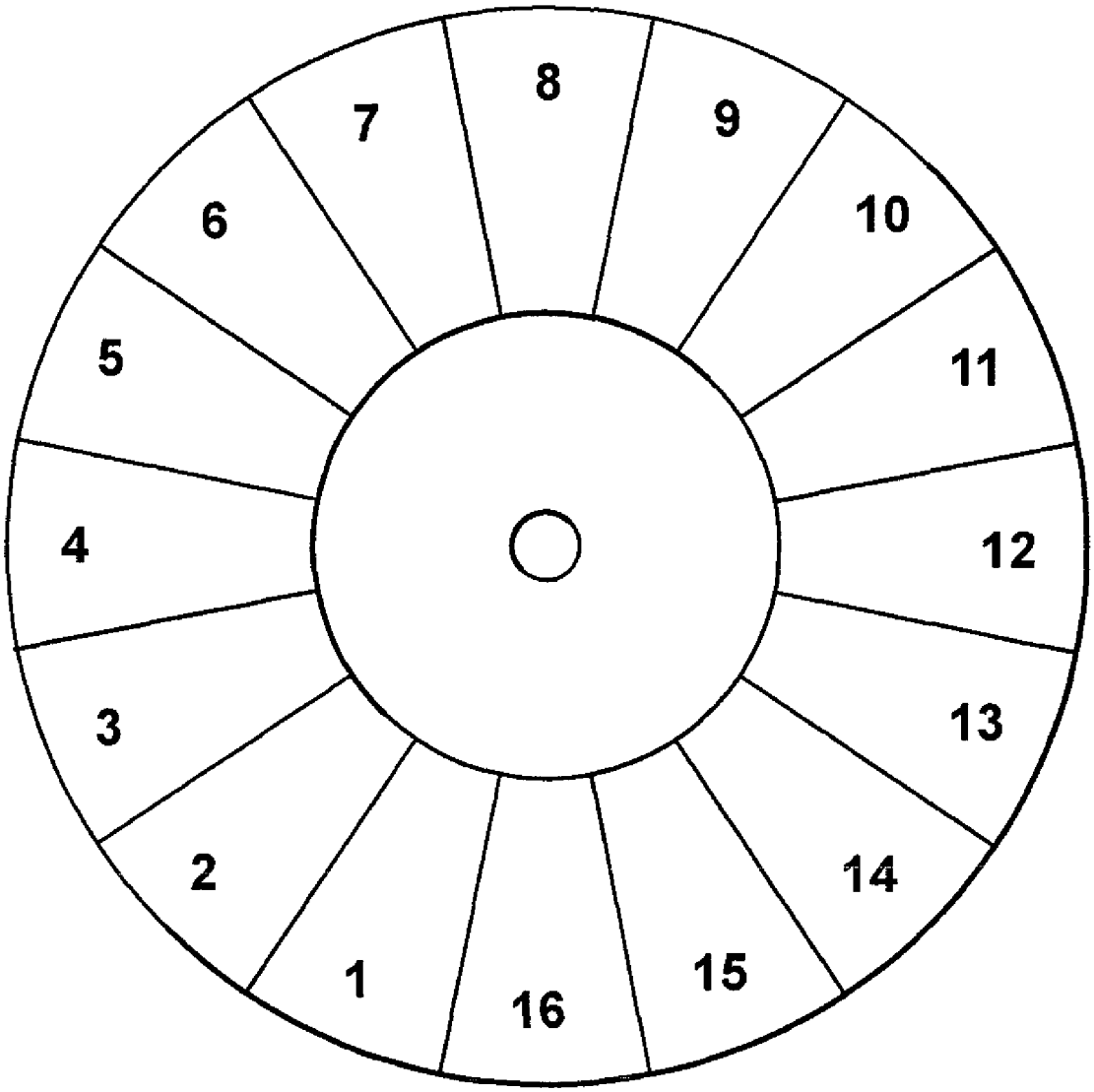

In the embodiment shown, each product carrousel 22 is comprised of a rotatable base plate 30, upon which a plurality of dispensing chutes 26 are radially located about the centre pivot 24. The product carrousel 22 comprises sixteen (16) dispensing chutes 26 (see FIG. 2 for an exemplary numbering convention). One skilled in the art will appreciate, however, that the product carrousel 22 can be configured with a greater or lesser number of dispensing chutes 26, as deemed appropriate for a particular implementation. Each dispensing chute 26 is defined by an outside end plate 32, an internal end plate 34 opposite the outside end plate, a first side wall 36, and a second side wall 38. In general, adjacent dispensing chutes 26 are designed to share side walls. One will appreciate, however, that separate side walls are possible, thereby permitting a space therebetween, if necessary.

Figure 3A:
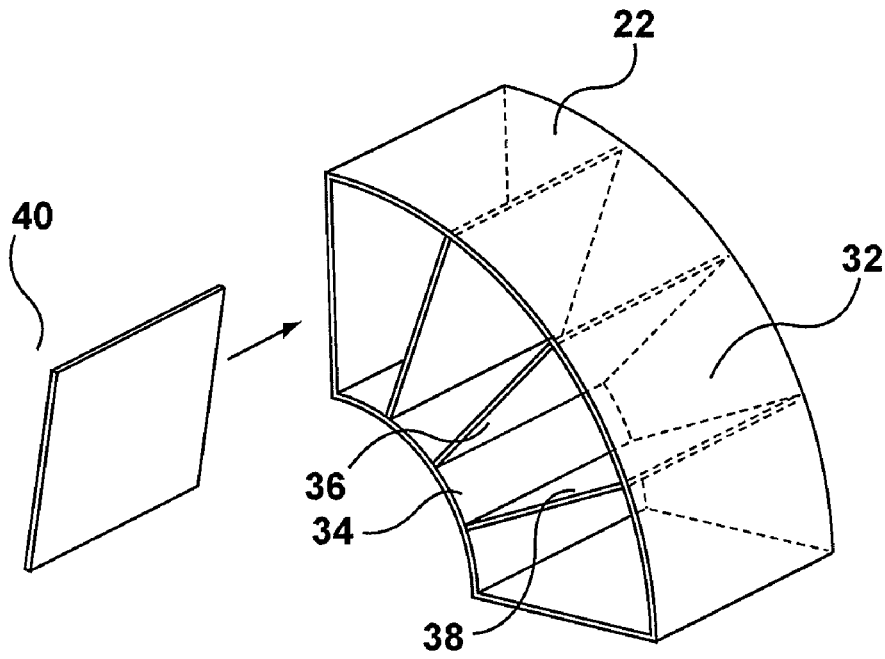
Figure 3B:
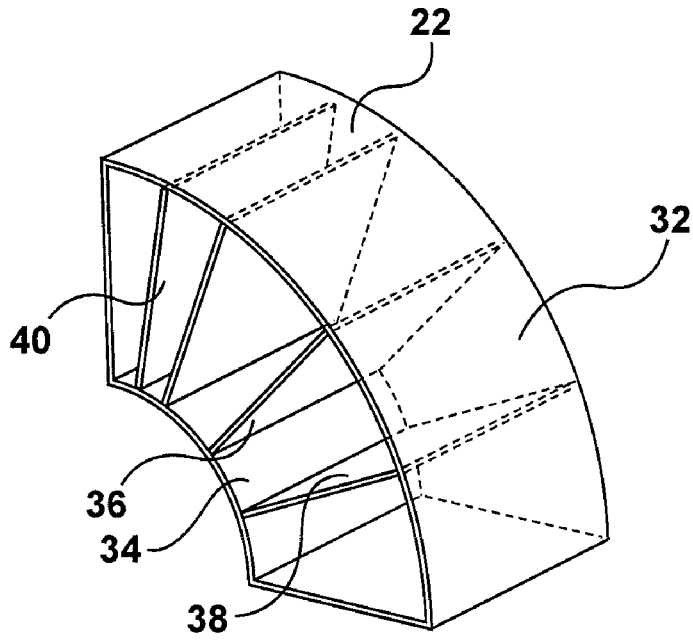

For ease of construction and to provide additional structural integrity to the carrousel, the outside end plates 32 defining the outside circumference of the carrousel 22 are provided as a continuous structure, but segmented sections that are suitably attached are also contemplated. A similar continuous configuration can be adopted for the internal end plates 34. With this arrangement, the dispensing chute 26 provides a suitable receptacle, appropriately dimensioned to hold a product to be dispensed. For example, the dispensing chutes 26 can be dimensioned to house 4 L containers (e.g. water, motor oil, antifreeze, etc). Alternatively, the dispensing chutes 26 can be dimensioned to hold larger or smaller containers, for example 1 L or 2 L containers. In one embodiment, the dispensing chutes 26 are generally sized for placement of 4 L containers, but are configured to allow easy and quick placement of suitable removable bisecting dividers 40, allowing for placement of 1 L or 2 L containers. An example of this configuration is shown in FIGS. 3*a* and 3*b*, in which a further radially oriented divider 40 is used to subdivide a dispensing chute 26, the divider 40 spanning the space between the internal end plate 34 and the outside end plate 32. The removable dividers 40 can be temporarily fastened in place using suitable threaded fasteners, clips, channels, magnets or other retainers apparent to one skilled in the art. Alternatively, the dividers 40 can be pressure-fit into position.

Figure 4A:
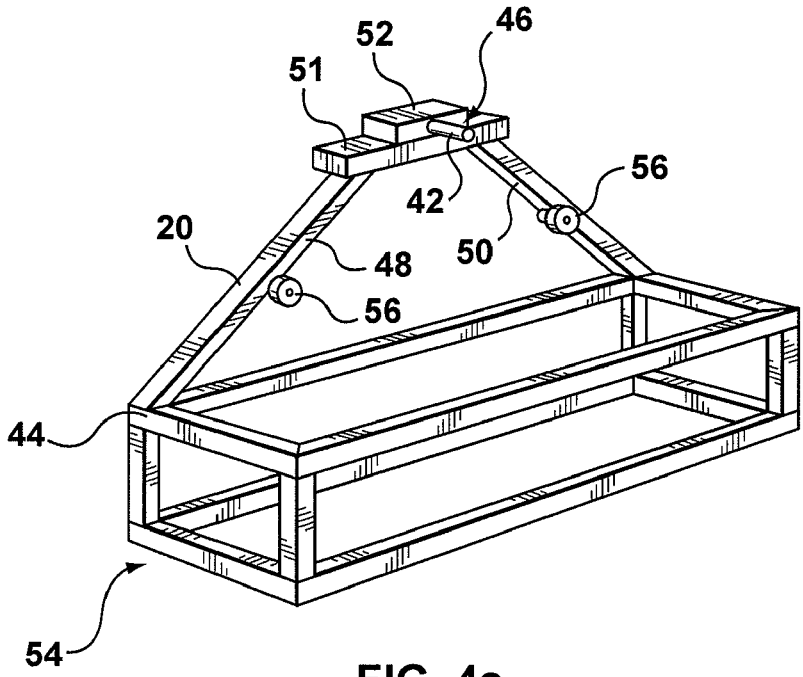
Figure 4B:
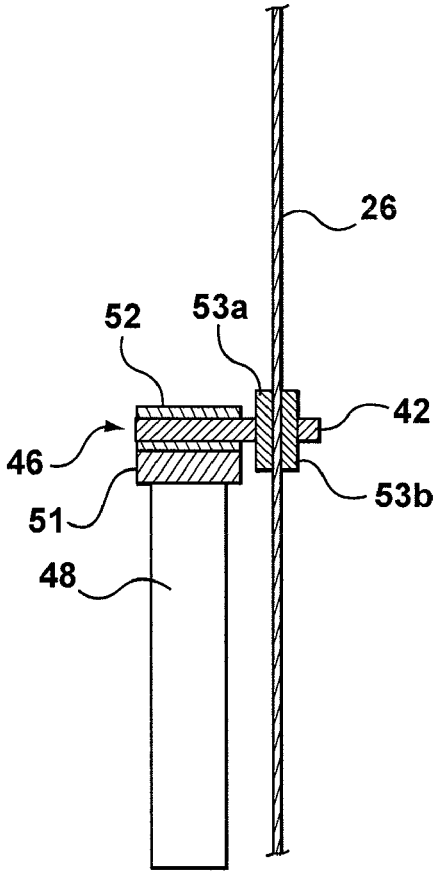

To support the carrousel 22 on the frame 20, a shaft mount configuration can be used. As shown in FIG. 4*a*, the shaft 42 is affixed to the frame 20, such as an A-frame structure comprising a base 44 and a central structural support 46. The central structural support 46 is generally comprised of at least two support beams 48, 50, the beams 48, 50 terminating at a generally horizontal cross-member 51. The cross-member 51 provides a support for the shaft 42 which is maintained in position using a suitable shaft mount 52. While the frame is shown as an A-frame structure, one skilled in the art will appreciate that other frame configurations can be implemented.

To facilitate smooth operation during dispensing, the product carrousel 22, and in particular the rotatable base plate 26 can be provided with suitable bearings 53 to minimize friction associated with rotation of the product carrousel 22 about the shaft. In one embodiment, the rotatable base plate is supported upon the shaft using at least one saddle bearing affixed to at least one side of the base plate. In the embodiment shown in FIG. 4*a*, the base plate is provided with two saddle bearings 53*a*, 53*b*, one provided on each side of the base plate, the pair of saddle bearings being fastened to the base plate, or alternatively to each other in manner that effectively sandwiches the rotatable base plate therebetween.

In some embodiments, the frame 20 is mounted on a sub-frame 54 that raises the dispensing device 10 to a level that places the dispensing position at a convenient height for a user. As shown, the sub-frame 54 is a box-frame that can be suitably dimensioned as a storage cabinet, for example to hold extra product for placement into the dispensing device 10 during refilling.

To further facilitate the rotation of the product carrousel 22, and to provide extra support for the shaft 42, at least one caster 56 can be used. In some embodiments, a plurality of casters can be used. For example, in the embodiment shown in FIGS. 1 and 4*a*, the product carrousel 22 is supported by two casters 56, one caster 56 being provided on each of the intersecting support beams 48, 50 of the central structural support 46 (caster on far side not visible in FIG. 1).

Figure 5:
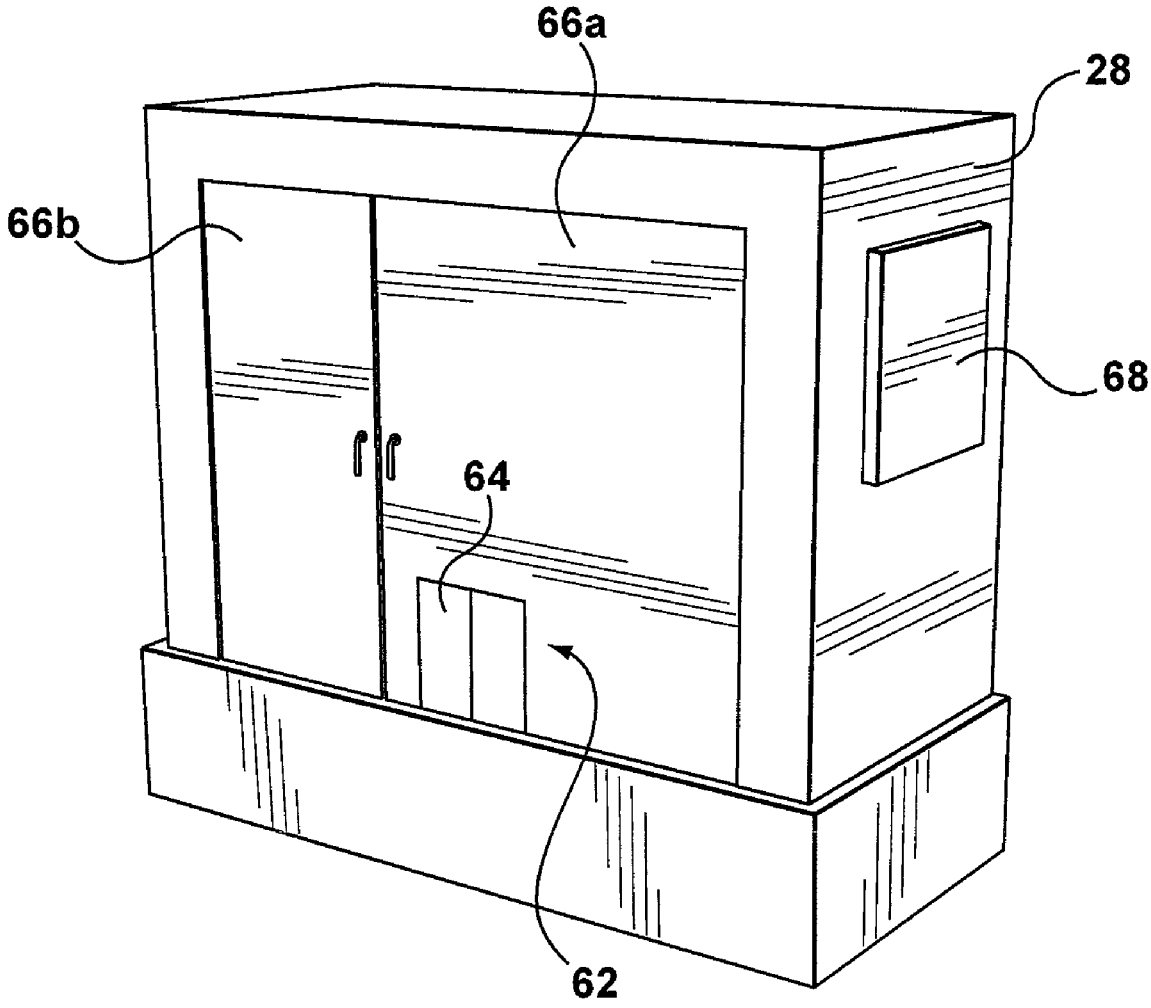
FIG. 5 is a perspective view of an embodiment of the dispensing device, showing a 70/30 split-configuration door.

FIG. 5 shows the dispensing device 10, complete with one example of a suitable housing 28. In one embodiment, a typical housing 28 would measure approximately 6 feet high, 6 feet long and 3 feet deep, but larger and smaller configurations are contemplated. The dispensing point 62 for the dispensing device 10 is the lowest rotational position of the product carrousel 22 about the pivot point 24 (e.g. generally the 6 o'clock position). At the dispensing point 62, there is provided on the housing an access port or door 64 which provides the user with access to the dispensing chute 26 located in that position. As can be appreciated, the door 64 can take on any number of configurations. For example, the door 64 could be hinged for push/pull operation, or provided in a suitable slot for upward or sideways sliding action. The door 64 could also be provided with a pivot point that allows the door to be rotated, thereby providing access to the dispensing chute. It is also possible that the door 64 be comprised of multiple sections, as shown in FIG. 5, thereby allowing only a smaller portion to be opened when the product carrousel has been configured to hold smaller product, for example 1 L water bottles, instead of 4 L containers. In some embodiments, the doors are further configured to automatically return to the closed upon completion of the transaction.

As mentioned above, the dispensing device 10 is located within a suitable housing 28, which can further comprise seals for suitable weather-proofing, if necessary. To facilitate the loading of product, and to allow for maintenance, the housing 28 can further comprise at least one lockable door that opens to expose substantially the entire product carrousel. In some embodiments, at least two lockable panel doors 66*a*, 66*b* are provided, as shown in FIG. 5. In this embodiment, the doors are arranged in a 70/30 split configuration, the larger door providing the dispensing door 64 in the 6 o'clock position. It will be appreciated, however, that the configuration of the panel doors is not intended to be limited to any one particular arrangement as a variety of configurations would be equally suitable for loading and maintaining the device.

Figure 6:
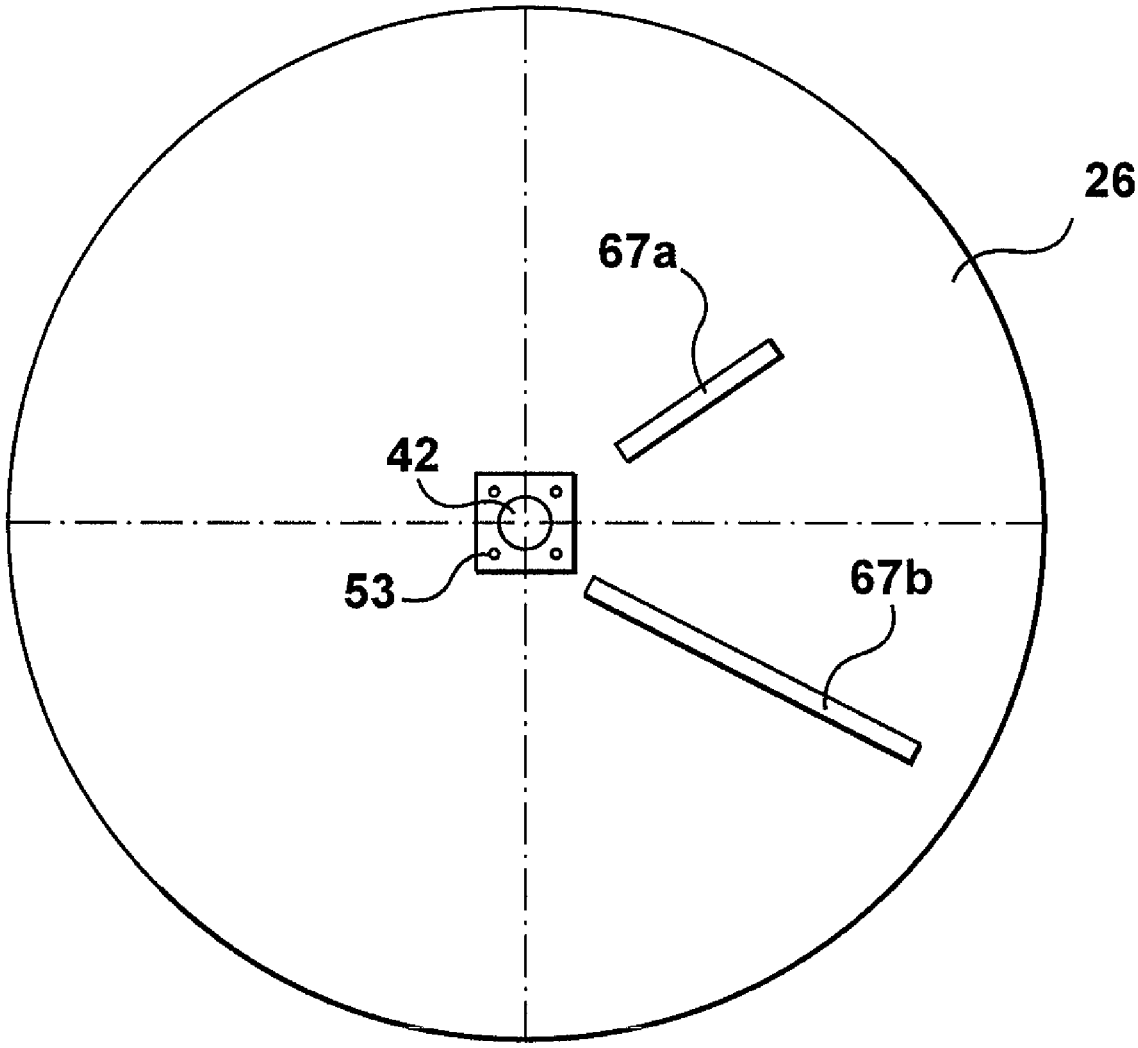
FIG. 6 is a schematic representation of the carrousel base plate, showing placement of ballasts on the rear face.

As indicated above, the work necessary to effect rotation of the carrousel 22 is provided by gravity from the product itself. As product is removed from the dispensing point 62 of the product carrousel, the resulting raised centre of gravity destabilizes the balance of the product carrousel 22, thus driving its rotation. As such, the next dispensing chute containing product moves into position at the dispensing point 62. To facilitate rotation of the product carrousel, ballasting can be used. As shown in FIG. 6, two ballasting weights 67*a*, 67*b* are affixed to the base plate 26, for example on the rear surface. With the carrousel positioned in the loaded and ready position, the first ballasting weight 67*a* is provided at the 2 o'clock position, the second ballasting weight 67*b* being provided at the 4 o'clock position. The second ballasting weight is generally twice the weight of the first ballasting weight, with the specific weighting and positioning of the ballast being dependent upon the product contained within the dispensing chutes. In some embodiments, the ballast is liquid ballast, contained within suitable ballast tubes or pipes positioned on the rear of the base plate.

Figure 7:
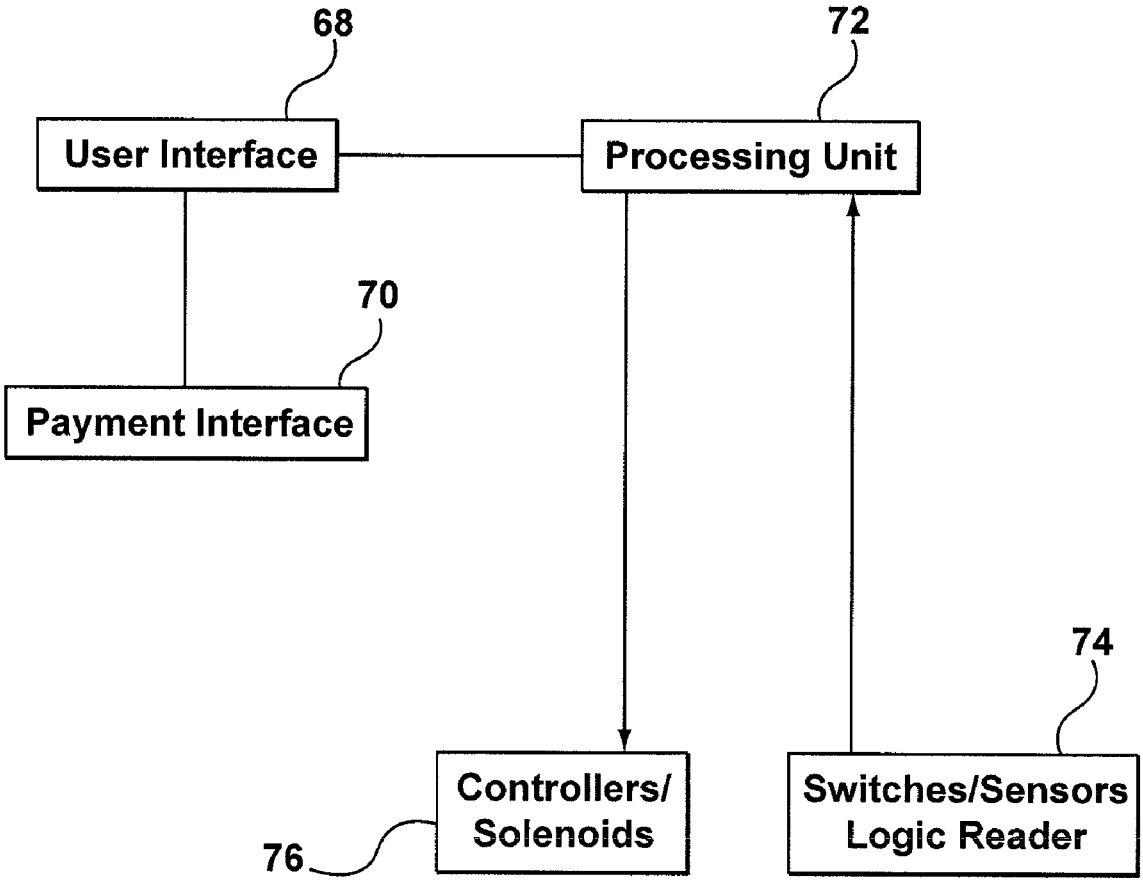
FIG. 7 illustrates the various components associated with the processing unit.

As shown in FIG. 7, the dispensing device 10 is configured with a user interface 68, and in particular a payment interface 70. In one embodiment, the payment interface is of the CARDLOCK™ configuration, which is an automated fuel control system. It will be appreciated, however, that other debit, credit, prepaid or customer card configurations could be used. For example, the payment interface can be configured with a magnetic card reader or proximity reader as generally known in the art. The user interface 68 can be configured to provide a range of information to the user. For example, the user interface can indicate through the use of suitable light indicators (e.g. LEDs) one or more of the following: Ready (e.g. lit on device being readied for next user), Start (e.g. lit on authorization of user choice of payment), Dispensing (e.g. lit during dispense cycle), Complete (e.g. lit at end of cycle when product ready for pick up), Out of Product. In terms of controls for the user, in one embodiment, the controls are restricted to one (1) button, namely a start button, although one skilled in the art can choose to implement additional control inputs for the user (e.g. a cancel button). The user interface may further comprise one or more of a display, a keypad, a receipt printer and any other interface component as generally known in the art of payment interface technologies.

The user interface is electronically connected to, or can be integral with a processing unit 72. The processing unit 72 allows for control and operation of the dispensing device 10. The processing unit 72 can be any suitable central processing unit (cpu), such as a microprocessor, computer, electronic chip, control board, logic controller, or a programmable controller. The processing unit 72 can be both programmable and expandable to accommodate desired changes and variations for a specific location or group of customers. The processing unit 72 is configured to receive various types of information from the product carrousel 22, using for example inputs from various switches and sensors 74 located in the dispensing device 10. The processing unit 72 is further configured to send instructions to various controllers 76 (e.g. pull-type drive solenoids; carrousel lock solenoid; door lock solenoid) on the dispensing device to effect control over its operation.

In one embodiment, the relay of information to the processing unit 72 is accomplished using story plates 77 and a cooperating logic reader 78, as shown in FIG. 8*a*. In this arrangement, the carrousel is configured such that every dispensing chute 26 is provided with a story plate 77 which provides details of various operational parameters, such as, but not limited to, start/stop position, product count, and product type. Other operational parameters could be incorporated into the story plate, as deemed necessary for the particular application. The story plate can be located on the circumferential face 80 of the outside end plate 32, or alternatively on the rear face of the rotatable base plate 30. As shown in FIG. 8*b*, the story plate 77 generally comprises a plurality of contacts arranged in a pattern that encodes information indicative of the dispensing chute to which it pertains. For example, in the embodiment shown in FIG. 8*b*, a first set of contacts 82 are used to provide information relating start/stop positioning, while a second set of contacts 84 are used to provide information relating to the product contained in the dispensing chute (e.g. size or volume of product). The logic reader 78 interacts with the story plate 77, registering the information encoded therein. This information is forwarded to the processing unit 72 and used for control and operation of the dispensing device by way of various relays used to signal controllers/solenoids 76 provided in the dispensing device 10. In one embodiment, the story plate 77 comprises a plurality of electrical contacts that interplay with corresponding electrical switches in the logic reader 78. In a further embodiment, the story plate 77 comprises a plurality of lobes that physically interact with contact switches in the logic reader 78. In yet a further embodiment, the story plate 77 comprises a code that is read by optic sensory pickup by the logic reader 78. Regardless of the type of story plate/logic reader technology implemented, the interplay between the story plate and logic reader serves to provide the processing unit 72 with the information necessary to effect proper control over the operation of the dispensing device 10. It will be appreciated that this transfer of information can be accomplished in a wide variety of ways and is not intended to be limited to the various examples provided above.

As mentioned above, in one embodiment, the dispensing device is configured to dispense product from the 6 o'clock position. It has been recognized that a logic reader 78 placed to read a story plate 77 on the dispensing chute in the 6 o'clock position would in fact be located at the lowest point in the dispensing device 10, making it susceptible to damage from the elements, or fluid leakage from defective containers. While placement of the logic reader in the 6 o'clock position is one possible arrangement, it is advantageous to locate the logic reader 78 at a higher location within the housing 28, for example the 3 o'clock position. As a result, in this arrangement, it is necessary to offset the story plate 77 from the dispensing chute 26 to which is pertains. For example, if the logic reader 78 is located at the 3 o'clock position, and the dispensing position is located at the 6 o'clock position, the story plate 77 for each dispensing chute 26 will need to be offset by 90°. In other words, using the numbering convention shown in FIG. 8*a*, the story plate 77 for dispensing chute #16 is located on dispensing chute #12. This way, when dispensing chute #16 is rotating into the dispensing position at 6 o'clock, the logic reader 78 at 3 o'clock is receiving information necessary to effect proper control over the dispensing device 10.

The information received by the processing unit 72 is used to control various solenoids located in the product carrousel. For example, to ensure alignment of the dispensing chutes with the dispensing point, a locking mechanism can be used, such as one or more carrousel solenoids to lock the product carrousel in a targeted predefined position (e.g. the dispensing position). In one embodiment, as shown in FIGS. 8*a* through 8*c*, the carrousel solenoid 76*a* is a spring based solenoid that engages a corresponding receptacle 79 in either the outside end plate of the dispensing chute, for example on the story plate itself, or the rotatable base plate. Engagement of the receptacle 79 by the spring based solenoid 76*a* has the effect of locking the carrousel from further rotation, for example while the dispensing door is open and the product is being removed from the dispensing chute. Further controls/solenoids can be implemented for safety of the user. For example, a door solenoid 76*b* can be used to lock the dispensing door 64 during rotation of the product carrousel. A further controller, such as an magnetisable coil 76*c* can be used to hold the dispensing door in the open position for a set period of time once the dispensing door is released for opening by the user.

Further controls can include an out-of-product sensor that communicates an out-of-product condition to the processing unit. For example, the dispensing unit can be configured to use a suitable sensor (e.g. a photo electric sensor) to detect when the final dispensing chute is empty. Alternatively, the out-of-product sensor can comprise a switch 76*d* located in the last dispensing chute (e.g. dispensing chute #16). Removal of product from the last dispensing chute will trigger the pressure switch, thereby identifying an out-of-product condition. Upon detection of an out-of-product condition, the processing unit places the dispensing device into an out-of-service mode, so as to prevent further users from attempting to use the device. In the event of an out-of-product condition, the dispensing device is configured with an out-of-product or out-of-service indicator, such as an illuminated indicator. Further, in the event of an out-of-product condition, the dispensing device can be configured to communicate this condition to a central operating station, as discussed in greater detail below.

The dispensing device can be configured with additional features, such as a product count, as well as a load bypass option which disengages the carrousel during refilling. For example, the processing unit can be configured to recognize an unlocked front panel door upon which the carrousel solenoids disengage, allowing for free rotation of the carrousel during refill. Further control/operation features will be apparent to one skilled in the art.

A typical operating sequence for the dispensing device is represented by FIG. 9. Upon detection of a user (step 100), for example by insertion of a payment means (currency, credit card, CARDLOCK™, etc.), the dispensing device powers up and initializes into a ready mode. Initialization into ready mode can be accompanied by illumination of a ready light or other indicating lighting, and possibly enhanced illumination of certain operational sections of the device, such as the dispensing chute. Upon engaging a start button (e.g. push or pull type, step 110), as provided on the user interface, the processing unit instructs the carrousel solenoid to disengage the product carrousel, while further instructing the door solenoid to engage and lock the dispensing door (step 120). With the wheel disengaged and the dispensing door locked, the carrousel is free to rotate to the next dispensing position (step 130). From this point, the center of gravity of the product itself rotates the product carrousel into the next dispensing position. The user interface can be further configured with an 'in-use' indicator that illuminated during the rotation of the product carrousel. As the product carrousel rotates, the story plate corresponding to the dispensing chute entering the dispensing area begins to engage the logic reader (step 140). As the logic reader reads the inputs from the story plate, for example the dispensing chute size and corresponding start/stop points (step 150), the processing unit instructs the carrousel solenoid to lock the product carrousel into the appropriate position, while further instructing the door solenoid to release the door (step 160). To ensure the safety of the user, the release of the door by the door solenoid is a condition that depends upon a confirmed engagement between the carrousel solenoid and the respective receptacle. The user is then able to open the door and retrieve the purchased product (step 170). If provided with a receipt printer, the user extracts the receipt and the transaction is complete. The dispensing device then returns to a ready mode, ready for the next transaction (step 180).

In the aforementioned example where the door remains unlocked until a user engages the device, it will be appreciated that on initial set up of the dispensing device, a 16-chute product carrousel will provide 15 loaded product chutes, with the remaining unloaded chute being the chute in the 6-o'clock unloading position.

As mentioned above, the dispensing device is configured to use a particular a payment interface, for example a CARDLOCK™ interface. It will be appreciated, however, that other point of sale payment methods, such as debit, credit, prepaid or customer card configurations could be used. In addition, the dispensing device, and in particular the processing unit can be configured with a downloadable memory to capture transaction and condition information during usage, particularly where the dispensing device is configured for standalone applications. Alternatively, the dispensing device can be wired or wirelessly connected to a central control centre (e.g. a Kardtech Server) for receiving and processing transaction (e.g. transaction authorization) and condition/operational information from the processing unit. For example, the dispensing device can be configured to communicate through a cellular modem or other suitable wireless technology as generally known in the art. As such, the dispensing devices can be monitored remotely, alerting the central control centre to conditions (e.g. out of service) requiring a service call. While a dispensing device can be configured for a particular payment interface and communication technology (e.g. wireless point of sale), they can also be configured to provide a combination of options, for example both point of sale and CARDLOCK™. The dispensing devices may be configured with the ability to communicate using more than one communication methodology as certain applications may benefit from such a set up. It will be appreciated that a variety of configurations with respect to the payment interface and communication methodology are possible and all are intended to be suitable for use in the dispensing device described herein.

Although described as a single carrousel contained in a housing, the dispensing device can be configured with two or more product carrousels (multiple carrousels). For example, two product carrousels can be placed back-to-back, offering a greater product selection at any one location. In a scenario of multiple carrousels, the multiple carrousels can be provided in separate but attached housings, each housing comprising a separate frame. Alternatively, the multiple carrousels can be provided in a single housing comprised of a single frame structure.

In a further alternate embodiment, the carrousel could be configured with multiple wheels provided on the same side. For example, a smaller carrousel 86 could be nested within a larger carrousel 88, each carrousel being independently controllable. An example of this configuration is shown in FIG. 10. With a nested arrangement, the story plates or similar control mechanisms for at least the smaller nested carrousel would be placed on the rear of the smaller carrousel base plate. The various control solenoids would be configured to interact with the rear of the base plate, as the outside circumferential face would not be accessible. For dispensing, two dispensing doors would be provided, one dispensing door **90*a* for the larger carrousel, and a second dispensing door 90*b* for the smaller nested carrousel. An example of this configuration is shown in FIG. 10*b***. To provide additional structural support to one or both of the carrousels, castors can be used, similar to that suggested above with respect to a single carrousel configuration.

While configured for control using a processing unit and suitable user interface, the dispensing device could be fully manual, with the provision of a locking mechanism that serves to align each of the dispensing chutes with the dispensing point provided on the housing. A suitable locking mechanism could comprise a pin, such as a spring-biased pin that generally remains in the locked position until a user pulls the pin to disengage the product carrousel.

In some embodiments, the dispensing device is provided with a brake mechanism to prevent an excessive rotational speed of the carrousel as it positions to the next dispensing chute. For example, during the final ¼ rotation when only ¼ product is left in the device, the carrousel will demonstrate a greater rotational force, causing an un-braked carrousel to rotate faster in comparison to a fully loaded dispensing device. To moderate the rotation, a suitable brake can be used. Brake mechanisms can include mechanical braking system which imparts a frictional force on the carrousel during certain portions of the rotation, such as through the final ¼ rotation. In one embodiment, information obtained from the story plate with respect to the location of the carrousel in its rotation is used to operate an actuator that imparts a given braking force, so as to modulate the carrousel rotation. It will be appreciated that certain portions of the rotation will require a greater braking force than other portions of the rotation, meaning that an actuator with proportional control is recommended.

In another embodiment, the brake mechanism can be configured for energy recovery, wherein kinetic energy from the carrousel during braking is stored for usage in, for example, powering the processing unit. Exemplary energy recovery braking systems, also known as regenerative braking systems include compressed air energy storage as well as similarly configured liquid expansion energy storage. In compressed air energy storage, the carrousel is operably connected to suitable air pump which in turn is connected to an air tank.

The force necessary to compress the air during carrousel rotation imparts a braking effect to the carrousel. On completion of the rotation, that is once the device is empty, the compressed air stored in the storage tank can be released into a suitable generator to convert the energy stored in the compressed air to electricity. In liquid expansion energy storage, a liquid expansion device is similarly used. In this case, the carrousel is operable connected to a liquid pump that is in turn connected to a liquid expansion unit. The force necessary to pump the liquid into the liquid expansion unit imparts a braking effect to the carrousel. On completion of the rotation, the liquid in the liquid expansion device can be released into a suitable generator to convert the energy stored in the expanded liquid expansion device to electricity.

The release of the air or liquid in each respective energy recover device can either be an automated process through control from the processing unit, or can be a manual process controlled by the service technician that is dispatched to fill the unit on recognition that the device is empty. The energy created by the generator can subsequently be stored in one or more batteries for use as a supplemental power source for the processing unit.

In terms of materials suitable for use in constructing the above-described dispensing device, a non-limiting example of materials includes steel, plastics, aluminium and composites.

In one embodiment, the dispensing device is configured to operate on DC power, with power input coming from the use of one or more solar panels provided in association with the unit. For example, one or more solar panels can be mounted on the top of the dispensing device. The solar panels can be configured to charge one or more batteries (e.g. 12 volt battery) through a trickle charger or similar technology as generally known in the art. Also contemplated are the use of other energy generating sources, such as wind generators. Where available, connection to AC power is also contemplated.

While the foregoing provides certain embodiments and exemplary performances thereof, it is to be understood that variations, combinations and subsets of the teachings herein are contemplated. Examples are provided with the intent of describing exemplary embodiments, and are not intended to be limiting in any way. Alterations and modifications may be effected thereto, by those of skill in the art. The scope, therefore, is only to be limited by the claims appended hereto.

The invention claimed is:

1. A dispensing device comprising:

an upright rotatable product carrousel comprising a plurality of dispensing chutes for retaining a product, said dispensing chutes being radially located about a central pivot;

a dispensing point located at a lowest point of rotation of said product carrousel;

wherein removal of product from a dispensing chute located at said dispensing point results in rotation of the product carrousel to position an adjacent dispensing chute at said dispensing point, allowing for sequential removal of product from the product carrousel; and wherein said upright rotatable product carrousel further comprises at least one ballasting weight to facilitate rotation of the product carrousel in instances where the raised center of gravity is insufficient to induce rotation of said upright rotatable product carrousel.

2. The dispensing device according to claim 1, wherein said plurality of dispensing chutes of said product carrousel is provided on a rotatable base plate, rotatable about said central pivot.

3. The dispensing device according to claim 2, wherein each of said plurality of dispensing chutes is further comprised of a outside end plate, an inside endplate, and first and second side walls.

4. The dispensing device according to claim 1, further comprising a frame for rotatably mounting said upright rotatable product carrousel, said frame providing a shaft for mounting said upright rotatable product carrousel.

5. The dispensing device according to claim 1, wherein said dispensing device further comprises a housing having an access port or door located at said dispensing point, said access port or door being lockable upon rotation of said upright rotatable product carrousel.

6. The dispensing device according to claim 1, wherein said dispensing device further comprises a housing having at least one lockable door dimensioned to expose substantially the entire product carrousel upon opening.

7. The dispensing device according to claim 1, further comprising two ballasting weights, a first ballasting weight being located at the 2 o'clock position on the upright rotatable product carrousel, and the second ballasting weight being located at the 4 o'clock position on the upright rotatable product carrousel, the second ballasting weight being generally twice the weight of the first ballasting weight.

8. The dispensing device according to claim 1, further comprising a user interface having at least one of a magnetic card reader, a proximity card reader, a display, a keypad, and a receipt printer.

9. The dispensing device according to claim 8, wherein said user interface is a payment interface configured to enable payment using at least one of an automated fuel control system, credit card, and debit card.

10. The dispensing device according to claim 8, wherein said user interface provides indicators to inform a customer of one or more of a ready state, a start state, a dispensing state, a complete state and an out-of-product state.

11. The dispensing device according to claim 8, further comprising a processing unit for receiving operational information from the upright rotatable product carrousel and controlling operations of the dispensing device.

12. The dispensing device according to claim 11, wherein said operational information is provided through the use of story plates provided on each of the dispensing chutes, each story plate encoding information about a corresponding dispensing chute, the story plates being read by a logic reader provided in the dispensing device.

13. The dispensing device according to claim 11, wherein said processing unit is configured to communicate with a remote location through at least one of wired communication and wireless communication.

14. The dispensing device according to claim 1, further comprising one or more sensors to detect operational conditions of the dispensing device.

15. The dispensing device according to claim 14, wherein at least one sensor is provided to detect an out-of-product condition.

16. The dispensing device according to claim 1, wherein a plurality of dispensing devices are provided in a single housing having a common frame structure.

17. The dispensing device according to claim 1, wherein two dispensing devices are located back-to-back.

18. The dispensing device according to claim 1, further comprising a brake mechanism to control the rotation of the upright rotatable product carrousel, said brake mechanism being at least one of a mechanical braking system and an energy regenerative braking system.

19. The dispensing device according to claim 1, wherein the dispensing device operates on DC power.

20. The dispensing device according to claim 19, wherein said DC power is provided through the use of solar panels provided on at least one surface of the dispensing device.

21. A dispensing device comprising:

a frame presenting a shaft;

an upright rotatable product carrousel comprising a central pivot mounted on said shaft, said product carrousel being configured to rotate about said shaft, said product carrousel having a plurality of dispensing chutes for retaining a product, said dispensing chutes being radially located about said central pivot;

a housing for encasing at least said upright rotatable product carrousel, said housing providing a dispensing point at a lowest point of rotation of said product carrousel;

a stop mechanism configured to align each of said dispensing chutes at the dispensing point;

wherein removal of product from said dispensing chute located at said dispensing point, and disengagement of said stop mechanism results in rotation of the product carrousel to position an adjacent dispensing chute at said dispensing point, allowing for sequential removal of product from the product carrousel; and wherein said upright rotatable product carrousel further comprises at least one ballasting weight to facilitate rotation of the product carrousel in instances where the raised center of gravity is insufficient to induce rotation of said upright rotatable product carrousel.

* * * * *